United States Patent [19]

Pejrud

[11] 4,067,537

[45] Jan. 10, 1978

[54] ARRANGEMENTS FOR MOVABLY SUPPORTING DISPLAY ELEMENTS

[76] Inventor: Lennart Erik Pejrud, Lennartnas, Farentuna, Sweden

[21] Appl. No.: 681,229

[22] Filed: Apr. 28, 1976

[30] Foreign Application Priority Data

Apr. 28, 1975 Sweden ..... 7504918

[51] Int. Cl.[2] ..... A47G 1/16

[52] U.S. Cl. ..... 248/476; 248/495; 248/497; 248/489; 248/316 F

[58] Field of Search ..... 248/476, 489, 495, 496, 248/497, 498, 214, 215, 316 F; 211/89

[56] References Cited

U.S. PATENT DOCUMENTS

| | | | |
|---|---|---|---|
| 506,682 | 10/1893 | Ferris | 248/498 |
| 730,055 | 6/1903 | Smith | 248/489 |
| 1,035,319 | 8/1912 | Cormier | 248/497 |
| 1,908,200 | 5/1933 | Webster | 248/495 |
| 2,867,918 | 1/1959 | Miller | 248/214 |
| 3,384,987 | 5/1968 | Prechtl | 248/489 |
| 3,399,429 | 9/1968 | Goodman | 248/489 |

FOREIGN PATENT DOCUMENTS

| | | | |
|---|---|---|---|
| 12,436 | 6/1904 | United Kingdom | 248/495 |

*Primary Examiner*—Marion Parsons, Jr.

*Attorney, Agent, or Firm*—Birch, Stewart, Kolasch & Birch

[57] ABSTRACT

An arrangement for movably supporting a display element, such that said element can be moved essentially in a universal manner relative to a stationary supporting surface. The arrangement comprises a composite rail means having a wooden portion and a metal portion connected thereto. The metal portion provides means for removably holding paper sheets and the wooden portion has an open groove extending along at least part of its length. A stirrup-like structure is provided at one end thereof with a peg having a round bottom portion, said rounded peg portion being received in the groove for axial movement therealong and pivotal movement therein. Means are provided for securing the stirrup-like structure to the display element.

8 Claims, 5 Drawing Figures

ARRANGEMENTS FOR MOVABLY SUPPORTING DISPLAY ELEMENTS

BRIEF SUMMARY OF THE INVENTION

The present invention relates to an arrangement for movably supporting a display element. More particularly, the invention relates to an arrangement for supporting a movable object on a stationary object in a manner such that the movable object can be moved substantially horizontally relative to the stationary object and pivoted about a line which is substantially horizontal to the stationary object.

The present invention is primarily intended for use in supporting blackboards, notice-boards, projection screens, projection shelves and similar display elements on the walls of a room. When supporting such display elements, it is desirable that said elements can be moved along the wall or walls on which they are supported without it being necessary to lift said elements. It is also an advantage if such elements can be pivoted relative to the wall so as to form an angle therewith. The arrangement of the present invention satisfies both of these requirements. By means of the arrangement according to the present invention, such display elements may be supported either along a wall or across a corner between two walls without requiring modification. The supporting arrangement is also simple to manufacture, inexpensive and flexible.

The present invention comprises an arrangement for movably supporting a display element, said arrangement comprising a strip having an outwardly open groove along one side thereof and having means for securing said strip substantially horizontally to a supporting surface, at least one stirrup-like structure is provided with means for securing said structure to the display element to be supported, and a peg mounted to the stirrup-like structure, said peg having a round end portion which is received in the recess thereby to support the stirrup-like structure by abutment with said recess.

The peg conveniently comprises a hemi-spherical end portion and a substantially circular cylindrical portion connected thereto.

Alternatively, the round end portion of the peg may be dimensioned so that, when supporting the stirrup-like structure and the display element connected thereto, it abuts the bottom of the groove and the side walls thereof.

When the display element to be supported is of such size that the provision of one stirrup-like structure would not afford the desirable stability, two stirrup-like structures each having a peg may be provided, said stirrup-like structures being arranged in spaced relationship when supporting the display element. The groove in the aforementioned strip is common to both pegs.

The strip is suitably manufactured from wood, preferably Eangkok teak, and is attached to a metal member, preferably a profiled extruded aluminum member, which is provided with means for attaching the same to a supporting surface, such as a wall.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

So that the invention will be more readily understood and optional features thereof made apparent, exemplary embodiments of the invention will now be described with reference to the accompanying drawings which are given by way of illustration only, and thus are not limitative of the present invention, and wherein.

DETAILED DESCRIPTION

Figure 1:
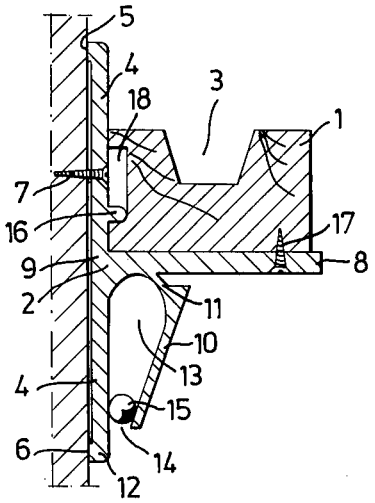
FIG. 1 is a diagrammatic sectional view through a strip.

In FIG. 1 there is shown in section a wooden strip 1, attached to an extruded aluminium member 2. The wooden strip is preferably made of Bangkok teak and has extending along one surface thereof a recess 3, the shape and purpose of which will be hereinafter described with reference to FIG. 3.

The aluminium member 2 has a first, elongate portion 4 which is substantially straight. Arranged at either end of the first portion 4 are substantially planar abutment surfaces 5 and 6 which are intended to bear against the supporting surface, such as the wall of a room, the aluminium member being provided with holes to receive screws 7 for securing said member to said surface.

The aluminium member has a second, elongate and substantially straight portion 8 which joins with and extends approximately perpendicularly from the center portion 9 of the first elongate portion 4.

The aluminium member has a third elongate portion 10 which is partially curved as shown at 11. The third elongate portion 10 joins with the second portion 8 and extends obliquely outwardly therefrom and terminates in the vicinity of the end 12 of the first elongate portion 4. As a result of the partially curved shape of the third portion 10, there is formed an open space 13 which is defined by the third portion 10, a minor part of the second elongate portion 8 and approximately half of the first elongate portion 4. The space 13 has an opening 14, the dimensions of which in cross-section are smaller than the largest cross-sectional dimensions of the space. The space is intended to receive metal balls 15 or rollers of such size as to prevent them from passing out through the opening 14. The rollers or balls are intended to secure sheets of paper inserted through the opening, said sheets of paper being gripped between the balls or rollers and the opposing surface of the first elongate portion 4.

The aluminium member is conveniently provided with a flange 16 which extends outwardly from the first elongate portion 4 in the vicinity of and in the same direction as the second elongate portion 8. The purpose of the flange is to secure the wooden strip 1 to the aluminium member 2. Also, holes are provided in the second elongated portion 8 for receiving screws 17. The wooden strip is provided with a recess 18 for receiving the flange 16, thereby to facilitate securement of the strip to the extruded aluminium member. The recess 18 is such as to enable it to accommodate the heads of screws 7 when screws are used which protrude from the surface of the aluminium member. Irrespective of the type of screws used to secure the elongate member to a supporting surface, it will readily be perceived that the screws are hidden by the wooden strip 1.

Figure 2:
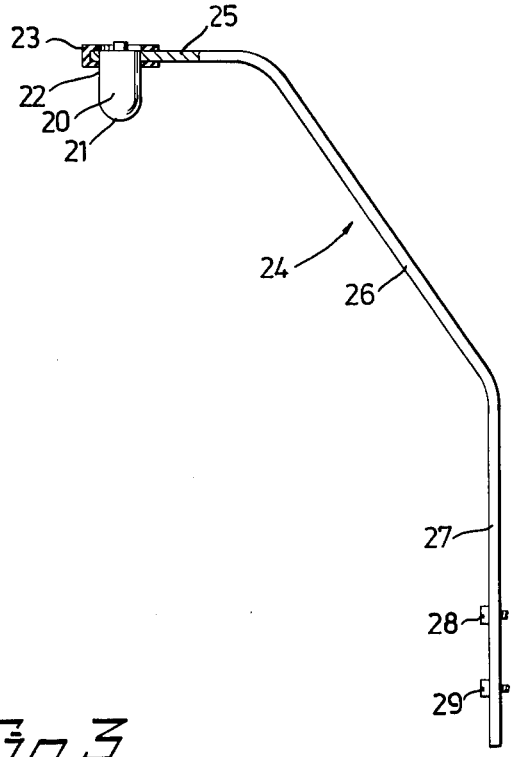
FIG. 2 is a diagrammatic side view of a stirrup-like structure.

The elements referenced 1 to 18 in FIG. 1 as a unit form a composite rail having an open, wedge-shaped recess which extends substantially horizontally when the rail is attached to a supporting surface. The wedge-shaped recess is intended and shaped to co-act with a peg 20 attached to a stirrup-like structure 24, as shown in FIG. 2. The shape of the recess 3 will be described more specifically hereinafter with reference to FIG. 3.

Referring to the illustrated embodiment of FIG. 2, the peg 20 is preferably made of metal, conveniently brass. The peg has a rounded end portion 21 which is intended to be placed in the recess 3 in abutment with a defining wall of the recess so as to support the stirrup-like structure and a display element. By "rounded" is meant that the end portion has a shape which corresponds substantially to part of a sphere. In FIG. 2 the end portion is shown to be hemi-spherical in shape, although part-spherical shapes greater than or smaller than hemi-spherical are conceivable.

The peg has a substantially circular cylindrical stem portion 22 adjoining the rounded portion. The diameter of the circular cylindrical stem is preferably substantially equal to the diameter of the sphere, although this is not absolutely necessary. The diameter of the cylindrical stem may be smaller than the diameter of the sphere, for example when the part-spherical end portion is larger than a hemi-sphere. The diameter of the cylindrical stem, on the other hand, should not exceed the diameter of the sphere to any great extent.

The peg 20 is attached in a known manner to a first end portion 25 of the stirrup-like structure 24. The outermost part of this end portion and the part which surrounds the peg when said peg is received in the groove, is covered by a protective rubber body 23.

The stirrup-like structure 24 is preferably made of a nickel-plated iron strip and has a central portion 26 connected to said first end portion and forming an angle therewith. The stirrup-like structure has a second end portion 27 which is connected to the center portion 26 and forms an angle therewith. The second end portion 27 extends preferably at right-angles to the first end portion and is provided with means for attaching the same to a display element to be supported, said means in the illustrated embodiment having the form of screws 28, 29 and holes (not referenced) for said screws.

Figure 3:
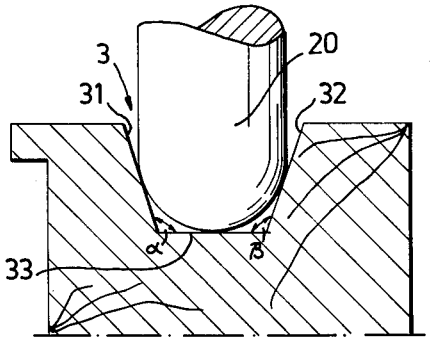
FIG. 3 is a sectional view in larger scale of a recess and a peg received therein.

FIG. 3 is a sectional view in larger scale of a peg 20 placed in a recess 3. The recess is open on one side thereof, i.e. open upwardly when in use, and is delimited by two substantially planar side walls 31 and 32 and a substantially planar bottom wall 33. The side walls 31 and 32 form obtuse angles $\alpha$ and $\beta$, respectively, with the bottom wall; the opening of the recess being wider than the bottom wall. The angles $\alpha$ and $\beta$ are preferably equal to one another, although this is not a necessary feature. Hereinafter, such a recess will be termed a wedge-shaped recess. A recess in which the adjacent portions of the bottom wall and respective side walls are not sharply defined but are radiused to a greater or lesser extend is also included in the term wedge-shaped.

The peg 20 received by the wedge-shaped recess has a hemi-spherical end portion, the diameter of which is such that said end portion abuts both side walls 31 and 32 and the bottom wall 33 when said peg is subjected to the load of the stirrup-like structure and a display element attached thereto. It will readily be perceived that the peg can be pivoted to the left and to the right as seen in FIG. 3, through an angle of at most $\alpha - 90°$ and $\beta - 90°$ around the center of the sphere with said end portion remaining in abutment with all three abutment surfaces. It will also be understood that the peg can be pivoted about its longitudinal axis without necessarily disengaging the abutment of said peg with the abutment surfaces. Neither need this abutment be disengaged when the peg is moved longitudinally in the groove, provided that the groove is of constant cross-sectional area along the whole or part of its length. Thus, it will be seen that the display element supporting arrangement of the present invention, comprising a strip having a recess arranged in one surface thereof and a stirrup-like structure provided with the aforementioned peg, will afford practically universal movement of the display element.

Although the aforedescribed wedge-shaped recess is to be preferred, the same movement possibilities are obtained with open-top grooves of other configurations. Instead of the illustrated wedge-shaped groove, grooves are conceivable in which the bottom wall is not completely flat but partially flat or fully curved. The bottom wall, for example, may have the shape of a part-circular cylinder. In principle it is not necessary for the side walls to be planar, but that the cross-section of the recess as a whole may have the form of a segment of a circle which is smaller than a semi-circle. Furthermore, in principle it is not necessary to provide a separate bottom wall, but that the recess may have the form of a triangle when seen in cross-section.

As previously mentioned, however, the illustrated wedge-shaped groove is the preferred shape over round and V-shaped recess shapes. When the groove is of V-shape cross-section, there is a risk that the peg will fasten or bind in the groove, unless the angle between the side surfaces is relatively large. However, a large angle between the side surfaces will provide an opportunity for the peg to jump out of the groove when the display element is being pivoted. A groove of round cross-section is more expensive and more difficult to make in most cases than a wedge-shaped recess when considering tolerances which must be observed if the peg is to move smoothly, longitudinally in the groove. In the majority of cases dust and/or other particles will collect on the bottom of the recess. When the recess is of wedge-shaped configuration, the peg during its movement along the groove is able to move the dust and/or the particles to the region where the bottom wall merges with respective side walls. The effective operation of the arrangement is therefore not adversely influenced by noderate quantities of dust and/or dirt particles. This is not the case when the groove has a circular cross-sectional shape with approximately the same diameter as the diameter of the rounded end portion of the peg. A groove having a circular cross-sectional shape provides no dead space for accommodating such dust and/or dirt particles upon movement of the peg along the groove. With a wedge-shaped recess and a peg such as those shown in FIGS. 2 and 3, the angle between the side surfaces, i.e. $\alpha + \beta - 180°$, is significant both with respect to the extent to which the peg can pivot, and with respect to the force which is required in a specific direction to cause the peg to leave the groove. The angle between the side surfaces should therefore be between approximately 30° and approximately 80°, preferably between approximately 40° and approximately 50°. The depth of the recess is also significant to a certain extent and said depth should preferably be approximately equal to the diameter of the sphere.

Figure 4:
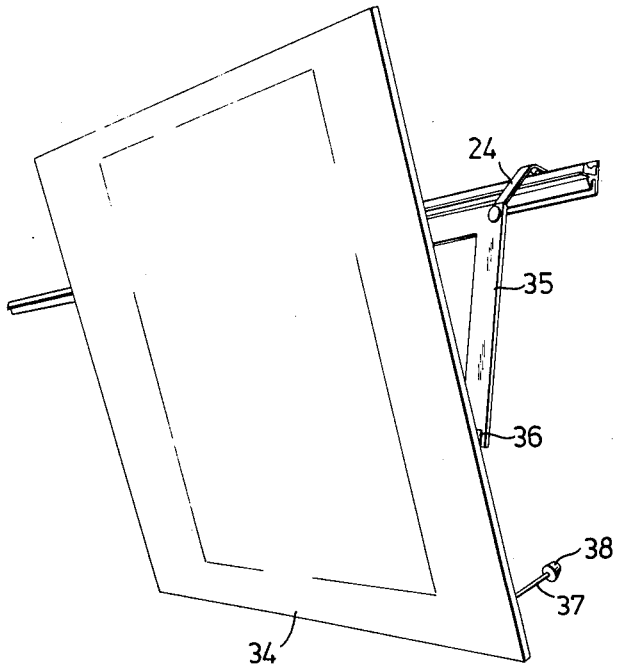
FIG. 4 illustrates diagrammatically a projection screen supported on a wall by means of an arrangement according to the present invention.

FIG. 4 shows a projection screen 34 supported on a wall by means of an arrangement according to the invention. With this embodiment, two stirrup-like structures 24, of which one is hidden by the screen, each being provided with a peg, are mounted to a wooden frame 35. The wooden frame is pivotally mounted to the projection screen by two hinges 36, of which part of one can be seen at the right edge of the screen. The lower portion of the screen is provided with two supports 37 which hold it spaced from the wall. The outermost portions 38 of the supports have a form, and are made of a material which will not damage the wall and which will provide a high degree of friction thereagainst. The angle formed by the screen with the wall can be varied within certain limits by suitable positioning of the hinges and the supports. This is made possible by the fact that the pegs may be rotated in the recess relative to a substantially horizontal line extending parallel with the longitudinal direction of said recess.

Figure 5:
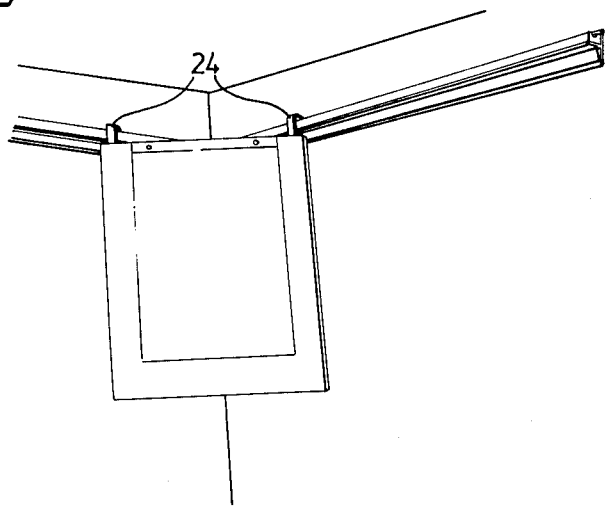
FIG. 5 illustrates a scribbling block supported in a corner of the room by means of an arrangement according to the present invention.

In FIG. 5 there is shown a scrap-block supported in a corner of a room by means of an arrangement according to the invention. Each of two stirrup-like structures 24 provided with pegs are attached to a respective upper corner of the scrap-block. Two supports 37 of the type shown in FIG. 4 are attached to the lower portion of the scrap-block, these supports being hidden in FIG. 5 by the block. The scrap-block can be moved from its corner position with the pegs sliding in the recess of the strip so that the scrap-block is practically parallel with one of the walls. The block can also be pivoted about a horizontal line through the pegs. The scrap-block can be supported along a wall instead of in a corner without it being necessary to modify the supporting arrangement. Similarly, the projection screen shown in FIG. 4 can be supported in a corner of a room instead of along a wall without modifying the supporting arrangement.

As will be understood, the display elements shown in FIGS. 4 and 5 are only examples and that other elements can be supported by the arrangement according to the invention, and that the elements need not be supported on walls or in the corner of a room.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The claims defining the invention are as follows:

1. An arrangement for slidably and pivotally supporting a display element and comprising:

a strip including an outwardly open groove along one side thereof, the groove including a wedge-shaped cross-section;

means for securing the strip to a supporting surface with the groove substantially horizontal and upwardly open; and at least one stirrup-like structure including a peg arranged to abut the groove so as to support the stirrup-like structure on the strip, the peg including an end portion of substantially part-spherical shape of such dimensions that the part-spherical surface abuts both the bottom wall of the groove and its side walls when subjected to the load of the stirrup-like structure and a display element carried thereby.

2. An arrangement for slidably and pivotally supporting a display element and comprising:

a strip including an outwardly open groove along one side thereof, the groove including a wedge-shaped cross-section with an angle between the side surfaces of between approximately 30° and approximately 80°;

means for securing the strip to a supporting surface with the groove substantially horizontal and upwardly open;

at least one stirrup-like structure including a peg arranged to abut the groove so as to support the stirrup-like structure on the strip; and the peg including an end portion of substantially hemi-spherical shape of such dimensions that the hemi-spherical surface abuts both the bottom wall of the groove and its side walls when subjected to the load of the stirrup-like structure and a display element carried thereby, the peg including a shank portion joined to the end portion, the shank portion being substantially circular cylindrical with a diameter not exceeding the diameter of the sphere.

3. An arrangement for slidably and pivotally supporting a display element and comprising:

a strip including an outwardly open groove along one side thereof, the groove including a wedge-shaped cross-section;

means for securing the strip to a supporting surface with the groove substantially horizontal and upwardly open;

two stirrup-like structures including a peg arranged to abut the groove so as to support the stirrup-like structure on the strip, each peg including an end portion of substantially hemi-spherical shape of such dimensions that the hemi-spherical surface abut both the bottom wall of the groove and its side walls when subjected to the load of the stirrup-like structure and a display element carried thereby; and means for attaching a display element to the stirrup-like structures.

4. An arrangement for slidably and pivotally supporting a display element either across a corner between two walls or along one of the walls without modification and comprising:

two strips each including an outwardly open groove along one side thereof, the grooves including wedge-shaped cross-sections of same size;

means for securing one of the strips to one wall and the other strip to the other wall with the grooves substantially horizontal and upwardly open;

two stirrup-like structures on each of which there is a peg arranged to abut a groove in the strips so as to support the stirrup-like structure on the strip, each peg including an end portion of substantially part-spherical shape of such dimensions that the part-spherical surface abut both the bottom wall of a groove and its side walls when subjected to the load of the stirrup-like structures and a display element carried thereby; and means for attaching a display element to the stirrup-like structures.

5. An arrangement for slidably and pivotally supporting a display element without modification either across a corner between two walls or along one of the walls and comprising:

two strips, each including an outwardly open groove along one side thereof, the grooves including wedge-shaped cross-sections of same size, the angle between the side surfaces of a groove being between approximately 30° and approximately 80°;

means for securing one of the strips to one of the walls and the other strip to the other wall with the grooves substantially horizontal and upwardly open; and two stirrup-like structures on each of which there is a peg arranged to abut a groove in a strip so as to support the stirrup-like structure on said strip, each peg including an end portion of substantially hemispherical shape of such dimensions that the hemispherical surface abut both the bottom wall of a groove and its side walls when subjected to the load of the stirrup-like structures and a display element carried thereby, each peg including a shank portion joined to the end portion, the shank portion being substantially circular cylindrical with a diameter not exceeding the diameter of the hemisphere.

6. An arrangement for slidably and pivotally supporting a display element comprising:

a strip member including a top surface, two downwardly projecting side surfaces and a bottom surface;

a portion of the top surface of the strip member includes an outwardly open groove;

said groove including a U-shaped, wedge cross-section;

means for securing the strip to a supporting surface with the groove substantially horizontal and upwardly open;

at least one stirrup-like structure including a peg arranged to slidably abut only the groove portion of the strip member; and the peg including an end portion shaped to engage the groove by only abutting against a bottom wall and the side walls of the groove.

7. An arrangement for movably and pivotally supporting a display element according to claim 6, wherein:

the groove includes a U-shaped, wedge cross-section with an angle between the bottom wall and the side walls of the groove being approximately 30° to approximately 80°.

8. An arrangement for movably and pivotally supporting a display element according to claim 6, wherein:

the peg includes an end portion of substantially hemispherical shape; and the peg further includes a shank portion being substantially of circular cylindrical shape with a diameter not exceeding the diameter of the sphere.

* * * * *